US007944674B2

(12) United States Patent
McCahon et al.

(10) Patent No.: US 7,944,674 B2
(45) Date of Patent: May 17, 2011

(54) BARRIER PIERCING ELECTRODE

(75) Inventors: Stephen William McCahon, Tucsom, AZ (US); Paul Bryan Lundquist, Tucson, AZ (US)

(73) Assignee: Applied Energetics, Inc., Tucson, AZ (US)

( * ) Notice: Subject to any disclaimer, the term of this patent is extended or adjusted under 35 U.S.C. 154(b) by 1454 days.

(21) Appl. No.: 11/277,386

(22) Filed: Mar. 24, 2006

(65) Prior Publication Data

US 2010/0108352 A1 May 6, 2010

(51) Int. Cl.

| | |
|---|---|
| ***G03G 15/02*** | (2006.01) |
| ***H05F 3/00*** | (2006.01) |
| *F23Q 3/00* | (2006.01) |
| *F23Q 5/00* | (2006.01) |

(52) U.S. Cl. ..... 361/225; 361/253; 361/257; 361/261

(58) Field of Classification Search ..... 361/225, 361/247, 253, 257, 261

See application file for complete search history.

(56) References Cited

U.S. PATENT DOCUMENTS

| | | | | |
|---|---|---|---|---|
| 4,429,323 | A | 1/1984 | Ohtsuka | |
| 5,210,719 | A * | 5/1993 | Lawrence | 367/139 |
| 5,350,416 | A * | 9/1994 | Guderian | 607/72 |
| 5,599,346 | A * | 2/1997 | Edwards et al. | 606/41 |
| 6,037,715 | A | 3/2000 | Hammon, III et al. | |
| 6,090,105 | A | 7/2000 | Zepeda et al. | |
| 6,542,790 | B1 | 4/2003 | Loucks | |
| 2002/0026185 | A1 | 2/2002 | Gough | |
| 2005/0073797 | A1 | 4/2005 | Smith et al. | |
| 2005/0104495 | A1 | 5/2005 | Hiramatsu | |

* cited by examiner

*Primary Examiner* — Dharti H Patel

(74) *Attorney, Agent, or Firm* — Duft Bornsen & Fishman LLP; Gregory T. Fettig

(57) ABSTRACT

An electrode is provided that is adapted to both pierce a barrier and providing an over-air discharge of electrical energy. In this regard, an over air discharge of electrical energy may be provided to an opposing side of a barrier. In one arrangement, the electrode includes a tapered point, which may be a hardened material, to facilitate piercing a barrier. In a further arrangement, the electrode incorporates an insulative shaft. In this arrangement, the insulative shaft electrically isolates a conductor of the electrode from a conductive barrier. Accordingly, the electrode may be utilized to pierce metallic enclosures and provide an electrical discharge for the purpose of altering the operation of electronic device within such enclosures.

36 Claims, 5 Drawing Sheets

BARRIER PIERCING ELECTRODE

FIELD

Technological systems and methods herein are directed to an electrode for providing an over air discharge of electrical energy. More specifically, the present invention is directed to an electrode that is adapted to pierce a barrier and provide an over air discharge of electrical energy on an opposing side of the barrier.

BACKGROUND

The normal operation of electrical devices may be altered or terminated due to stray electrical energy, which may be caused by, for example, electromagnetic interference (EMI). In an effort to reduce the susceptibility of electronic devices to such stray electrical energy, most electronics are disposed within a conductive enclosure. Such an enclosure acts essentially as a Faraday cage that channels stray electrical energy away from an internal cavity of the enclosure. Accordingly, electronics disposed within the enclosure may be isolated from stray electrical energy. This same concept protects electronic devices that are disposed within any conductive enclosure. For instance, when an aircraft is struck by lightning, the outer conductive skin of the aircraft channels energy around the interior of the aircraft. This prevents electronic devices within the aircraft, for example, those utilized to control the aircraft as well as electrical devices within the interior of the aircraft (e.g., a passenger's personal computer), from damaging electrical energy.

While it is generally preferred to prevent stray electrical energy from being introduced into a conductive enclosure that contains electronics, there are instances where the introduction of such electrical energy may be desirable. For instance, it may be desirable to introduce stray electrical energy to electronic devices for the specific purpose of disabling or otherwise altering the operation of such devices. However, in instances where electronics are disposed within a conductive enclosure, it may be necessary to breach a conductive electrical barrier in order to provide such electrical energy to the electronic disposed therein.

SUMMARY

The present inventor has recognized that, in order to provide an electric discharge across a barrier for the purpose of altering the operation of electronic devices disposed beyond the barrier, it may be desirable to produce an electrode that is capable of both piercing the barrier and providing an over-air discharge of electrical energy. Further, the inventor has recognized that, in order to prevent such an electrode from grounding to a conductive barrier, it may be necessary to electrically isolate a conductive portion of the electrode that is disposed through the barrier from electric contact with the barrier.

The inventor has further recognized that such an electrode may be utilized to pierce thin conductive barriers (e.g., sheet metal), as well as thick/reinforced conductive barriers (e.g., plate metal), to access cavities disposed beyond such barriers. For instance, the electrode may be designed to penetrate a thin conductive barrier, such as the skin of a motor vehicle, which may include, without limitation, automobiles and aircrafts. The electrode may alternatively be designed to penetrate thick/reinforced barriers, which may be associated with, for example, military vehicles. The type of barrier through which the electrode is designed to be disposed may also dictate how the electrode is disposed through the barrier. For instance, in cases where thin conductive barriers are involved, the piercing electrode may be utilized similar to a lance or spear where a user thrusts the electrode through the barrier. In cases where thicker barriers are involved, the electrode may be incorporated into a mechanical delivery device such that the electrode is propelled through the barrier (e.g., similar to a harpoon).

The invention may be especially useful in penetrating conductive enclosures in order to disrupt electronic devices disposed therein. In this regard, the electrode may be disposed into such a cavity in order to discharge electrical energy. Such a discharge (e.g., an over-air discharge) may be received, at least in part, by electronic devices disposed within the cavity. This discharge may be of a magnitude that is operative to disable such devices or alter their functioning. For instance, the discharge may be of a magnitude that disables a motor vehicle or may be of a magnitude that is operative to cause the detonation of an electrically actuated explosive device.

According to a first aspect of the invention, the electrode includes an electrically insulative shaft and a conductor that extends through at least a portion of the shaft. A distal end of the conductor is exposed proximate to a distal end of the shaft. The electrode further includes a tapered point that is proximate to the distal end of the shaft wherein the tapered point is adapted to pierce a barrier. In this latter regard, the tapered point may be a hardened material (e.g., metal) that has a hardness that is in excess of the hardness of a barrier through which the electrode is designed to be disposed.

Various refinements exist to the features noted in relation to the subject aspect of the present invention. Further features may also be incorporated into the subject aspect of the invention as well. These refinements and additional features may exist individually or in any combination. For instance, the tapered point may be integrally formed with the distal end of the conductor. Alternatively, the tapered point may be a conductive point (e.g., metallic) that is electrically interconnected to the distal end of the conductor. In a yet further arrangement, the tapered point may be formed, at least in part, from the electrically insulative shaft. What is important is that the tapered point is disposed near the end of the shaft such that when the electrode is projected towards a barrier, the tapered point may contact the barrier and create an opening through which the remainder of the electrode may be disposed.

The electrically insulative shaft may have any appropriate configuration. For instance, the shaft may have any cross sectional shape, including, without limitation, round, square, triangular, etc. What is important is that the shaft electrically isolates a portion of the conductor disposed within the shaft from conductive elements (e.g., a conductive barrier) contacting the shaft. In this regard, the shaft may be formed as a sleeve or conduit through which at least a portion of the conductor extends. For instance, a distal end of the conductor may extend through the first end of the shaft while a proximal portion of the conductor may extend through the second end of the shaft. Such a proximal portion may be interconnected to a power supply.

A conductive element may extend between the conductor and the power supply. Such conductive element may include, without limitation, a flexible electrical cable. Such a flexible electrical cable may allow for the electrode to be moved relative to the power supply such that the electrode may be positioned for disposition through a barrier while interconnected to a power supply.

In any arrangement, it may be desirable to incorporate a switch into the system. This may allow for building up an electrical charge from the power supply prior to delivery to the conductor. In one arrangement, a switch may utilize a spark gap. In such an arrangement the spark gap may provide a predetermined voltage threshold for electrical discharge thereacross. Accordingly, once a voltage above the predetermined voltage threshold is achieved, the electrical charge may discharge across the spark gap and be provided to the distal end of the conductor where it may discharge over air or directly to a conductor. Use of such a spark gap provides a gas discharge through the distal end of the electrode even when the conductor is in electrical contact with the conductor. That is, the magnitude of the discharge may be sufficient to create a gas discharge irrespective of electrical grounding. Such a spark gap may be formed between first and second separate portions of the conductor. Alternatively, the spark gap may be incorporated in an electric cable connecting the piercing electrode to a power source. The spark gap may be filled with air or other gasses, and may be pressurized to optimize discharge characteristics. For example, the choice of gas and pressure can be chosen to optimize the time required for the spark gap to open after a discharge has occurred, to optimize the voltage threshold for breakdown, or to reduce the long term degradation of the spark gap due to multiple uses.

To provide additional structural integrity to the piercing electrode, the electrode may further incorporate a metallic sleeve disposed around at least a portion of the insulative shaft. In this regard, a hardened metal sleeve may be incorporated to permit the piercing electrode to pierce thicker conductive barriers. In such an arrangement, the conductive shaft electrically isolates the conductor from the metallic sleeve.

According to another aspect of the present invention, a piercing electrode is provided that includes a conductor that terminates at a distal end for discharging electrical energy and an insulative material that is disposed around at least a portion of the conductor. That is, the distal end of the conductor is disposed through the insulative material, which is operative to electrically isolate the portion of the conductor disposed within the insulative material. The electrode further includes a tapered point proximate to the distal end of the conductor that is adapted for piercing a barrier. In one arrangement, the distal end of the conductor forms a tapered point. In another arrangement, the tapered point is formed from a portion of the insulative material.

According to another aspect of the invention, a piercing electrode is provided that includes a conductive tip having a tapered point for piercing a barrier and an insulative shaft. In this aspect, the conductive tip extends from the shaft, which electrically isolates the conductive tip from the barrier after piercing the barrier.

A conductive element may be electrically coupled to the conductive tip, and at least a portion of the conductive element may extend through the shaft. In this arrangement, the conductive element and conductive tip may be separate elements or may be integrally formed. Accordingly, the conductive tip and conductive element may be dissimilar materials. For instance, the conductive tip may be a hardened metal, while the conductive element may be a softer, highly conductive metal (e.g., copper).

According to another aspect of the present invention, a piercing antenna is provided. The antenna includes a radiative element having a tip that is adapted to pierce a barrier and an insulative shaft. The tip of the radiative element extends from the shaft, which electrically isolates the radiative element from a barrier after piercing the barrier. In this arrangement, the radiative element is operatively interconnected to an RF source. In this regard, the radiative element is adaptive to emit radio frequency/electromagnetic energy. Such electromagnetic energy may be of a magnitude that interferes with the operation of electronic devices.

According to another aspect of the invention, a method is provided for piercing a barrier to provide an electrical discharge on an opposing side of the barrier. The method includes disposing at least a tip of an electrode through an electrically conductive barrier. In this regard, the tip of the electrode extends through the barrier from a first side to a second side such that at least the tip of the electrode is disposed beyond the second side of the barrier. A conductive element of the electrode is electrically isolated from portions of the electrode that are in contact with the barrier when disposed there through. However, a portion of the conductive element may be exposed on the second side of the barrier such that electrical energy may be discharged through the electrode. More specifically, the electrical energy may be discharged beyond the second side of the barrier such that over-air discharge may be created.

In one arrangement, discharging energy includes discharging electrical energy from the tip of the electrode. In such an arrangement, the tip of the electrode may form a portion of the conductive element extending through the electrode. In another arrangement, electrical energy is discharged from a portion of a conductive element that is disposed proximate to the tip.

The step of disposing the tip of the electrode through an electrically conductive barrier may include disposing the tip through a barrier into a cavity that is at least partially defined by the barrier. This may allow for discharging electrical energy into an enclosed cavity. As noted above, the step of disposing the tip through an electrically conductive barrier may be performed by hand or by utilizing a mechanical system to launch the electrode towards a barrier.

DETAILED DESCRIPTION

Reference will now be made to the accompanying drawings, which assist in illustrating the various pertinent features of the piercing electrode design. Although the invention will now be described primarily in conjunction with piercing conductive barriers to provide an electrical discharge into an enclosed cavity, it should be expressly understood that the invention may be applicable to other applications. For instance, aspects of the invention may be applied where it is desired to pierce any barrier (i.e., conductive or otherwise) for the purpose providing an electrical discharge on an opposing side of the barrier. In this regard, the following description of an electrically isolated piercing electrode is presented for purposes of illustration and description. Furthermore, the description is not intended to limit the invention to the form disclosed herein. Consequently, variations and modifications commensurate with the following teachings, and skill and knowledge of the relevant art, are within the scope of the design. The embodiments described herein are further intended to explain modes known of practicing the invention and to enable others skilled in the art to utilize the invention in such, or other embodiments and with various modifications required by the particular application(s) or use(s).

Figure 1:
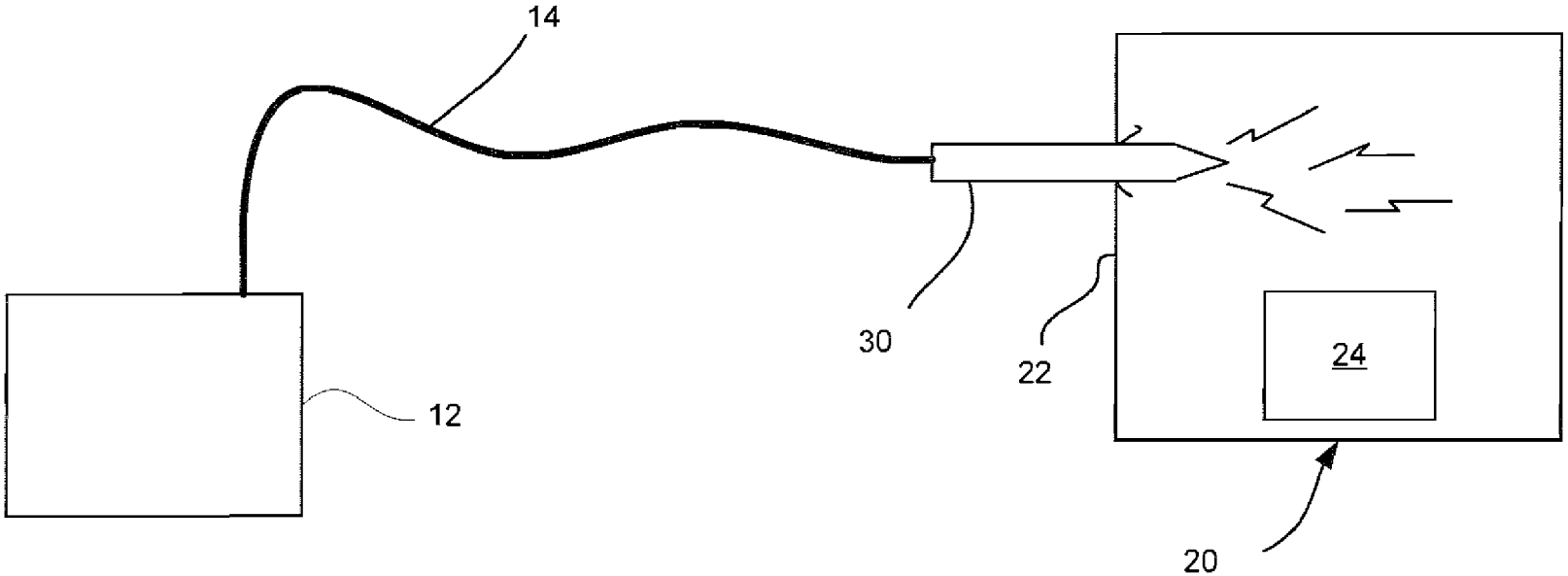
FIG. 1 illustrates one embodiment of a system that utilizes a piercing electrode.

FIG. 1 illustrates one embodiment of an electrical discharge system 10 that utilizes a piercing electrode 30. As shown, the system 10 includes a power source 12 for providing electrical energy, the piercing electrode 30, and an electrical conductor (e.g., cable) 14 that extends between the power source 12 and electrode 30. The system 10 further includes a switch, not shown, that is operative to discharge a built-up charge of electricity from the power source 12 through the electric conductor 14 to the piercing electrode 30. The discharge of electricity is of sufficient voltage and frequency to allow the electrical energy to discharge out of the end of the piercing electrode 30. That is, the discharge of electrical energy produces an over-air discharge of electrical energy out of the tip of the piercing electrode 30.

In the present embodiment, the piercing electrode 30 is adapted for disposition through a barrier of an enclosure 20 such that electrical energy may be discharged into a cavity/interior of the enclosure 20. Stated otherwise, the piercing electrode 30 may be disposed through a sidewall 22 of the enclosure 20 to provide a discharge of electrical energy to the interior of the enclosure 20. This electrical energy may alter the operation of one or more electrical devices 24 that may be disposed within or otherwise associated with the enclosure 20.

In instances where the sidewall 22 of the enclosure 20 is a conductor (e.g., metallic), the piercing electrode 30 may be inoperative to provide an electrical discharge into the interior of the enclosure 20 unless an outside surface of the piercing electrode 30 electrically isolates a conductive portion of the piercing electrode 30 from the sidewall 22. That is, without such electrical isolation, energy dissipated through the piercing electrode 30 may be conducted through the sidewall of the enclosure 20 to ground. This may prevent electronics 24 within the enclosure 20 from being affected by the discharge of electrical energy.

Accordingly, FIGS. 2-5 illustrate various embodiments of a piercing electrode 30 that is adapted to electrically isolate a conductive portion or conductor 34 from the outside surface of the electrode. In this regard, the piercing electrode 30 may be utilized to penetrate a conductive barrier (e.g., sidewall 22) such that a distal end or tip 36 of the conductor 34 is disposed across/through the barrier while the conductor 34 is electrically isolated from the barrier. This may enable providing an over air electrical discharge on an opposing side of the barrier (e.g., within the interior of the enclosure 20).

Figure 2A:
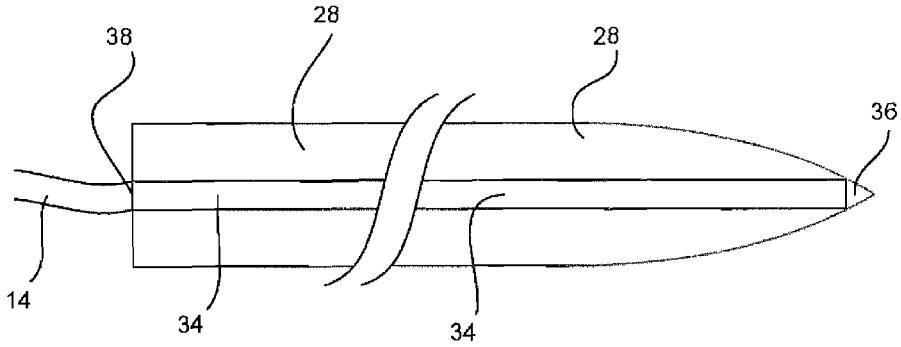
FIG. 2A illustrates a first embodiment of an electrically isolated piercing electrode.

FIG. 2A illustrates a side cross-sectional view of one illustrative embodiment of a piercing electrode 30. As shown, the electrode 30 includes a conductor 34 that is disposed through an insulating shaft/sleeve 28. In this regard, a proximal or rear portion 38 of the conductor 34 may be electrically connected to the electrical conductor 14 and thereby connected to the power source 12. The distal end or tip 36 of the conductor 34 may protrude through the end of the insulating sleeve 28. To permit the electrode 30 to be utilized to pierce a barrier, it may be preferable that the tip 36 comes to point to improve penetration. In this regard, it may be desirable that the tip of the conductor 34 be formed from a hardened metal. That is, it may be desirable that the conductor 34 or at least the tip 36 have a hardness that is in excess of a barrier for which the electrode 30 is designed to pierce. In one arrangement, a hardened tapered tip member may be interconnected to the end of the conductor 34 to provide improve penetration. Such a tapered tip member may be electrically conductive (e.g., metallic). Alternatively, the tip member 36 and the conductor may be integrally formed.

The insulating sleeve 28 surrounds the conductor 34 to provide electrical barrier between the conductor 34 and a potentially conductive barrier. In this regard, the insulating sleeve 28 may be formed any appropriate material that provides the desired level of electrical isolation. As may be appreciated, factors that may be utilized in selecting a material for the insulating sleeve 28 may include, without limitation, the expected voltages to be discharged through the electrode 30 and the environment in which the electrode will be utilized. In the latter regard, the impact strength of the insulating sleeve 28 may be selected based on intended use. Further, the thickness of the insulating sleeve 28 may also be selected for electrical and/or impact purposes. In one arrangement, the insulating sleeve 28 may be formed of glass fiber. In this arrangement, the sleeve 28 may be filament wound around the conductor 34.

Figure 2B:
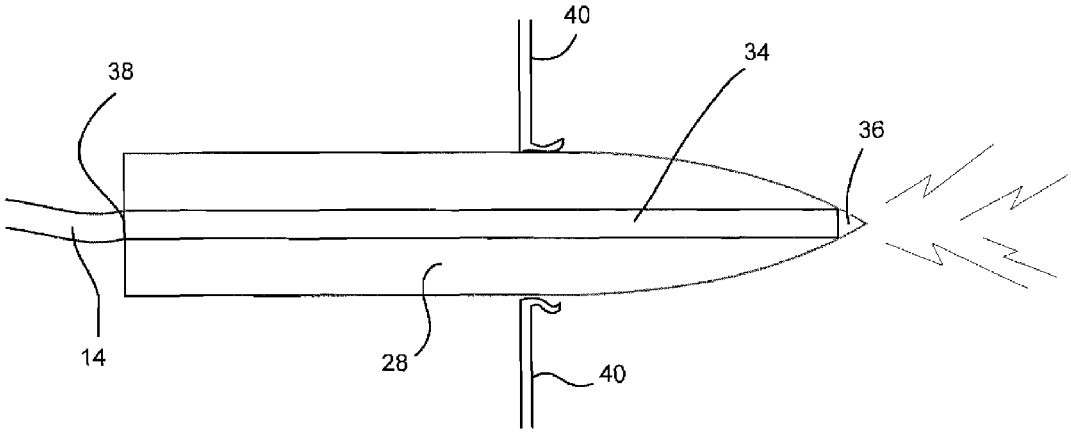
FIG. 2B illustrates the piercing electrode of FIG. 2A disposed through a barrier.

FIG. 2B illustrates the use of the piercing electrode 30 of FIG. 2A. As shown, the electrode 30 may be utilized to pierce a barrier 40 such that the distal tip 36 of the conductor 34 is disposed on opposing side of the barrier 40. For instance, the barrier 40 may be a metallic sheet. However, once the tip 36 of the electrode 30 is disposed a predetermined distance beyond the barrier 40, the only portion of the electrode 30 in contact with the barrier 40 is the insulating sleeve 28, which electrically isolates the conductor 34 from the barrier 40. Accordingly, an electrical discharge of energy from a power source may be provided via the electrical conductor 14, through the conductor 34 and to the tip 36 where an over air discharge may occur on the opposing side of the barrier 40.

Figure 3:
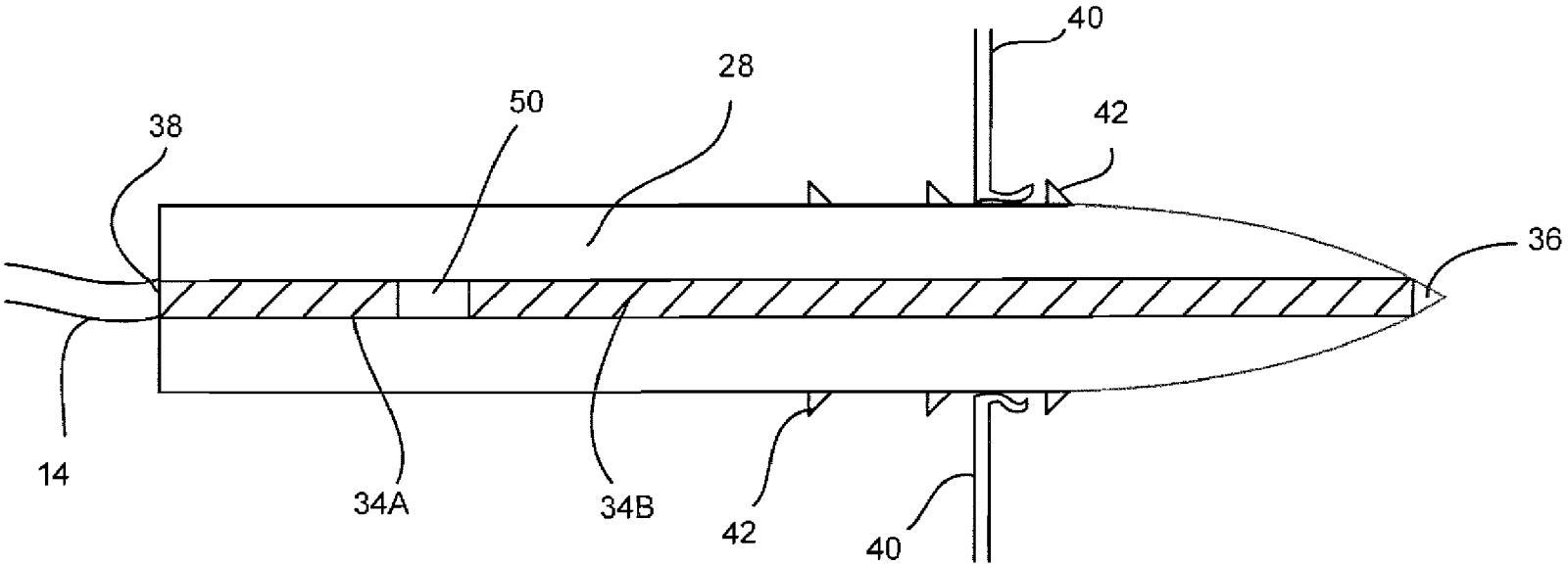
FIG. 3 illustrates a second embodiment of an electrically isolated piercing electrode.

Various refinements and additional features may be incorporated into the piercing electrode 30. For instance, as illustrated in FIG. 3, the piercing electrode 30 may include one or more barbs 42 on the outside surface of the insulating layer 28. These barbs 42 may prevent the electrode 30 from sliding back through the barrier 40 after the electrode 30 is disposed through the barrier 40. In this regard, the electrode 30 may maintain its position when disposed through the barrier 40 for delivery of an electrical discharge.

The embodiment of the electrode 30 illustrated in FIG. 3 also incorporates a spark gap 50. In this regard, the electrical conductor 34 is not continuous from its tip 36 to its rearward portion 38. Rather, the conductor includes the first portion 34A and second portion 34B that are separated by a space or spark gap 50. In the illustrated embodiment, the insulating layer 28 is utilized to maintain the spaced position of the first and second portions 34A and 34B to form the spark gap 50. However, it will be appreciated that other designs may be utilized to maintain a spark gap between any components of the system. In any case, the spark gap 50 allows for building up a predetermined charge of electrical energy prior to discharging electrical energy through the tip 36 of the electrode 30. That is, the electrical energy has to overcome the breakdown voltage of the spark gap 50 prior to being received by the second electrical conductor 34B. Use of the spark gap 50 may allow for the second conductor 34B to be in partial electrical communication with a conductive barrier 40 while still permitting an over air discharge across the barrier 40. That is, the electrical energy crossing the spark gap 50 may be of a magnitude that prevents complete grounding to the conductive barrier 40. Accordingly, a portion of the electrical energy may be discharged over the air on the opposing side of the barrier 40.

Figure 4:
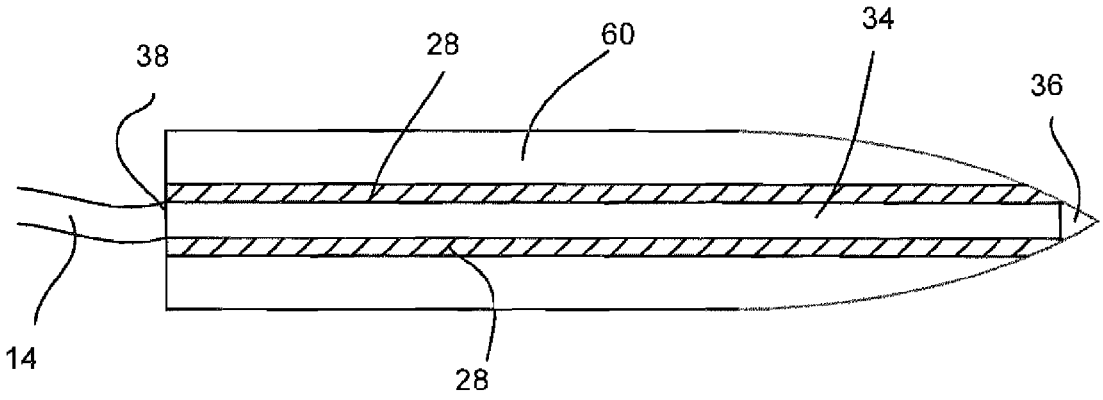
FIG. 4 illustrates a third embodiment of an electrically isolated piercing electrode.

FIG. 4 illustrates yet further embodiment of the piercing electrode 30. In this embodiment, the insulating layer 28 is again formed as a sleeve that is disposed around the electrical conductor 34. However, in this arrangement, a reinforcing sleeve 60 is disposed around the outside surface of the insulating layer 28. The reinforcing sleeve 60 may provide additional structural integrity for the electrode 30. For instance, the reinforcing sleeve 60 may be formed of a hardened metal. Use of the reinforcing sleeve 60 may allow for disposing the piercing electrode 30 through reinforced barriers while still electrically isolating the conductor 34 from the barrier.

Figure 5:
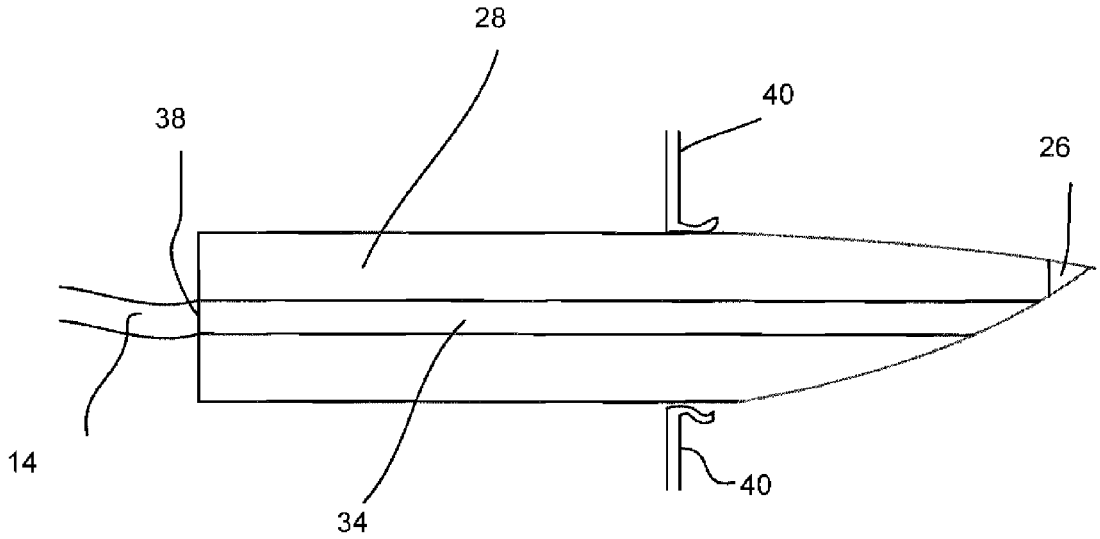
FIG. 5 illustrates a fourth embodiment of an electrically isolated piercing electrode.

FIG. 5 illustrates a further embodiment of a piercing electrode 30 where the conductor 34 is not utilized to pierce a barrier. Rather, a portion of insulating layer 28 incorporates a pointed tip 26 that is adapted for disposition through the barrier 40. In such an arrangement, the pointed tip 26 may include a hardened metallic cap to permit disposition of the piercing electrode 30 through, for example, metal.

As will be appreciated, the physical characteristics of the piercing electrode 30 are dependent upon the application for which it will be utilized. For instance, if the piercing electrode 30 is designed to penetrate into the cavity of, for example, a passenger vehicle having a thin barrier of relatively thin sheet metal (e.g., 20 gauge metal), the piercing electrode 30 may be designed for hand insertion. In this regard, the electrode 30 may have a length and weight that allows a user to, by hand, drive the electrode 30 through the barrier into a cavity behind the barrier. The user may then move away from the electrode 30 prior to discharge. In other arrangements, the piercing electrode 30 may be designed to penetrate thicker barriers including, for example, plate metal (e.g., ¼ inch or thicker). In such arrangements, the electrode may be designed for mechanically assisted disposition through a barrier. For instance, the piercing electrode 30 may be adapted for use as a projectile. In such an arrangement, the distance the electrode 30 could be projected may be limited by the length of the electrical connector 14. Further, in instances where the electrode is utilized to penetrate thicker barriers, it may be desirable to utilize a hardened metal casing, as discussed in relation to FIG. 4 above.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. For instance, it will be appreciated that many of the aspects noted above may be incorporated into a barrier piercing antenna. Such an antenna may be operative to pierce a barrier and transmit electromagnetic energy across the barrier (e.g., into a cavity). As may be appreciated, such an antenna may require the use of coaxial conductors to connect the antenna to the power source and to extend through the shaft. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. An electrode for disposition through a barrier comprising metal to provide an electrical discharge on an opposing side of the barrier comprising metal, comprising:

an electrically insulative shaft;

a conductor extending through at least a portion of said shaft, wherein a distal end of said conductor is exposed proximate to a distal end of said shaft;

a tapered point proximate to said distal end of said shaft, said tapered point being adapted to pierce a barrier comprising metal;

a conductive element electrically coupled to a proximal end of said conductor, wherein said conductive element is connectable to an electrical power supply; and a switch that conducts electrical energy from a first point of said conductive element to a second point of said conductive element.

2. The electrode of claim 1, wherein said shaft electrically isolates a portion of said conductor disposed within the shaft from conductive elements contacting the shaft.

3. The electrode of claim 1, wherein said distal end of said conductor forms at least a portion of said tapered point.

4. The electrode of claim 3, wherein said distal end of said conductor has a hardness that is greater than a hardness of a portion of said conductor disposed within said shaft.

5. The electrode of claim 1, wherein said distal end of said shaft forms at least a portion of said tapered point.

6. The electrode of claim 5, wherein said tapered point further comprises:

a hardened cap member, wherein said cap member has a hardness that is greater than a hardness of a material forming said shaft.

7. The electrode of claim 1, wherein said switch is a spark gap.

8. The electrode of claim 1, further including a power supply that provides electrical energy to said conductor, wherein said power supply supplies electrical energy having a magnitude sufficient to create an over air electrical discharge from said distal end of said conductor.

9. The electrode of claim 8, wherein said magnitude interferes with electronic devices proximate to said electrical discharge.

10. The electrode of claim 8, wherein said magnitude initiates explosive devices proximate to said electrical discharge.

11. The electrode of claim 8, wherein said power supply supplies electrical energy having a voltage of at least 10,000 volts.

12. The electrode of claim 1, further comprising:

a metallic sleeve, wherein said shaft is disposed within said sleeve and wherein said shaft electrically isolates said distal end of said conductor from said metallic sleeve.

13. An electrode for disposition through a barrier comprising metal to provide an electrical discharge on an opposing side of the barrier comprising metal, comprising:

a conductor terminating at a distal end for discharging electrical energy;

an insulative material disposed around at least a portion of said conductor, wherein said distal end of said conductor is exposed through said insulative material; and a tapered point proximate to said distal end of said conductor, said point being adapted for piercing the barrier comprising metal; and a power supply that provides electrical energy to said conductor, wherein said power supply supplies electrical energy having a magnitude sufficient to create an over air electrical discharge from said distal end of said conductor.

14. The electrode of claim 13, wherein said distal end of said conductor forms said tapered point.

15. The electrode of claim 13, wherein said insulative material comprises an insulative sleeve, wherein said conductor extends through at least a portion of said sleeve.

16. The electrode of claim 15, wherein said insulative sleeve forms a shaft.

17. The electrode of claim 16, wherein said shaft is between about 10 cm in length and about 500 cm in length.

18. The electrode of claim 13, wherein said insulative material forms at least a portion of said tapered point.

19. The electrode of claim 13, wherein said tapered point further comprises a tapered tip member attached to said insulative material, wherein a hardness of said tip member is greater than a hardness of said insulative material.

20. The electrode of claim 13, further comprising:

a metallic sleeve, wherein said distal end of said conductor is exposed through a surface of said metallic sleeve and wherein said insulative material electrically isolates said conductor from said metallic sleeve.

21. The electrode of claim 13, wherein said conductor is operative to transmit at least 800 kV of electrical energy free of damage to said conductor.

22. An electrode, including:

a conductive tip having a tapered point for piercing a barrier comprising metal;

an insulative shaft, wherein at least said tapered point extends from said shaft and wherein said insulative shaft electrically isolates the conductive tip from said barrier comprising metal after piercing said barrier comprising metal; and a conductive element electrically coupled to said conductive tip, wherein at least a portion of said conductive element extends through said shaft, wherein said conductive element includes a switch that conducts electrical energy from a first point of said conductive element to a second point of said conductive element.

23. The electrode of claim 22, wherein said switch is a spark gap.

24. The electrode of claim 22, further including a power supply that provides electrical energy to said conductive tip, wherein said conductive tip is operative to discharge said electrical energy across said barrier.

25. The electrode of claim 24, wherein said electrical energy has a magnitude that interferes with electronic devices.

26. The electrode of claim 24, wherein said electrical energy has a magnitude that initiates an explosive device.

27. An antenna, including:

a radiative element having a tip adapted to pierce a barrier comprising metal;

an insulative shaft, wherein at least said tip of said radiative element extends from said shaft, and wherein said shaft electrically isolates the radiative element from said barrier comprising metal after piercing said barrier comprising metal; and a conductive element electrically coupled to said radiative element, wherein at least a portion of said conductive element extends through said shaft, wherein said conductive element includes a switch that conducts electrical energy from a first point of said conductive element to a second point of said conductive element.

28. The Antenna of claim 27, wherein said switch is a spark gap.

29. The Antenna of claim 27, further including a power supply that provides electromagnetic energy to said radiative element, wherein said radiative element is operative to discharge said electromagnetic energy across said barrier.

30. A method for piercing a barrier comprising metal to provide an electrical discharge on an opposing side of the barrier comprising metal, comprising:

disposing at least a tip of an electrode through an electrically conductive barrier from a first side to a second side, wherein at least said tip is disposed beyond said second side of the barrier comprising metal;

electrically isolating a conductive element of the electrode from portions of the electrode which are contacting said barrier comprising metal; and discharging electrical energy through said electrode, wherein said electrical energy is discharged beyond said second side of said barrier comprising metal.

31. The method of claim 30, wherein said electrical energy is discharged from said tip.

32. The method of claim 30, wherein said electrical energy is discharged from a portion of the conductive element proximate to said tip, wherein said portion of said conductive element is disposed beyond said second side of said barrier comprising metal.

33. The method of claim 30, wherein disposing comprises disposing said tip through a barrier comprising metal into a cavity at least partially defined by said barrier comprising metal.

34. The method of claim 33, wherein said electrical energy is discharged into said cavity.

35. The method of claim 30, wherein disposing further comprises:

mechanically launching said electrode toward said barrier comprising metal.

36. The method of claim 30, wherein discharging comprises generating an over air discharge of said electrical energy.

* * * * *